US009782685B1

(12) United States Patent
Perez

(10) Patent No.: US 9,782,685 B1
(45) Date of Patent: Oct. 10, 2017

(54) DISPENSER THAT CONVERTS INTO A SPINNING TOY

(71) Applicant: Rolando H Perez, Miramar, FL (US)

(72) Inventor: Rolando H Perez, Miramar, FL (US)

( * ) Notice: Subject to any disclaimer, the term of this patent is extended or adjusted under 35 U.S.C. 154(b) by 0 days.

(21) Appl. No.: 15/161,207

(22) Filed: May 21, 2016

(51) Int. Cl.
*A63H 33/00* (2006.01)
*A63H 1/32* (2006.01)

(52) U.S. Cl.
CPC ..... *A63H 33/003* (2013.01); *A63H 1/32* (2013.01)

(58) Field of Classification Search
CPC ..... A63H 1/32; A63H 33/003; B65D 81/36
USPC ..... 446/71, 75, 76, 77, 250, 253
See application file for complete search history.

(56) References Cited

U.S. PATENT DOCUMENTS 1,258,464 A * 3/1918 Riley ..... A63H 3/52 446/254
1,321,836 A * 11/1919 McKenna ..... A63H 1/32 446/245
1,631,539 A * 6/1927 Larrair ..... A63H 1/22 446/245
1,851,769 A * 3/1932 Hutchinson ..... A63H 1/32 446/253
2,161,154 A * 6/1939 Gertler ..... A63H 1/32 446/253
2,975,547 A * 3/1961 Greve ..... A63B 67/16 206/216
2,992,510 A * 7/1961 Grangood ..... A63H 1/32 446/253
3,236,002 A * 2/1966 Cunningham ..... A63H 1/00 220/212
3,501,860 A * 3/1970 Bandy ..... A63H 1/32 446/253
3,721,037 A * 3/1973 Allen ..... A63H 1/32 446/244
4,008,526 A * 2/1977 Swett ..... A63F 9/06 434/259
4,189,862 A * 2/1980 Lopez ..... A63H 1/32 446/254
D272,223 S * 1/1984 Daenen ..... D7/629
4,878,868 A * 11/1989 Shaw ..... A63B 67/10 426/104
4,911,447 A * 3/1990 Pickard ..... A63F 5/04 273/141 R
4,986,790 A * 1/1991 Boury ..... A63H 1/32 446/219
5,356,328 A * 10/1994 Ho ..... A63H 1/30 446/242
5,392,945 A * 2/1995 Syrek ..... A63H 33/08 206/508
5,399,136 A * 3/1995 Bart ..... A63B 21/227 446/242
5,512,028 A * 4/1996 Sparks, III ..... A63B 21/0004 446/253
5,728,414 A * 3/1998 Terrasi ..... A23G 3/566 426/104

(Continued)

*Primary Examiner* — Melba Bumgarner
*Assistant Examiner* — Joseph B Baldori

(57) ABSTRACT

A Dispenser that converts into a spinning toy that is divided into a first, a second and a third section. The sections of the dispenser separate after the contents within the dispenser are consumed. The first, second, and third sections are connected to each other by a cord. After the dispenser is separated for use, the cord serves, when wound, as the means for providing a spinning movement of the toy when the toy is manipulated by the user.

1 Claim, 3 Drawing Sheets

(56) References Cited

U.S. PATENT DOCUMENTS

| | | | | |
|---|---|---|---|---|
| 7,651,097 | B2 * | 1/2010 | Kay | A63F 1/02 273/148 A |
| 2010/0203801 | A1 * | 8/2010 | Chan | A63H 1/32 446/248 |

* cited by examiner

DISPENSER THAT CONVERTS INTO A SPINNING TOY

BACKGROUND

The present invention is directed to a candy or pill dispenser that converts into a spinning toy after the contents housed within the dispenser are removed.

Today, children are more prone to playing with digital games than with physical products. The inventor of the present invention realized that he somehow had to again teach a child to play with physical products, for physical products develop coordination and physical skills that a digital game could never offer the child.

He remembered that in his youth he played with a toy that is similar to the toy described in U.S. Pat. No. 2,161,154 that was issued to I. Gertler. A simple toy that allowed children to grasp the extremities of a toy and manipulate the toy so that the toy could spin along a central axis. The toy was manipulated by the child in the manner described in the Gertler patent.

The present invention uses the mechanism of the Gertler patent in the present invention.

The inventor devised a manner of introducing a physical spinning toy to a child in a manner in which the child would not be led to believe that he was being forced to play with a physical product. The physical product would then serve to increase the child's motor skills. By housing candy or gum in the food item, the child would be swayed into buying the dispenser. After the food item is consumed, the inventor believes that the child would eventually use the dispenser as a toy.

For the foregoing reasons, there is a need of having a candy or pill dispenser that, after the contents of the dispenser are consumed, can be transformed into a spinning toy that can be manipulated by a child.

SUMMARY

The present invention is directed to a candy or pill dispenser that, after the contents of the dispenser are consumed, can be transformed into a spinning toy that can be manipulated by a child.

The dispenser of the present invention is divided into a first, a second and a third section. The first section is a dispenser top section that defines a first section cavity within the circumference of the first section. The first section has a top and a bottom, the top section of the first section is a first section wall that defines a circumference, the bottom section of the first section is a circular first section wall that flows perpendicularly from the circumference of the first section wall, the circular first section wall defines the cavity of the dispenser top section, and the first section wall defines two centrally positioned first section attachment points. The second section is defined by a circular central wall that that further defines a central axis structure that is perpendicular to the circular central wall and that is attached to the circular central wall by at least to spokes, each spoke allows any item within the circular central wall to pass from a side of the central axis structure to another side of the central axis structure, the central axis structure defines at least two centrally positioned attachment points, the circular central wall has a top and a bottom end, and each end bevels inward. The third section is a dispenser bottom section that defines a cavity within the circumference of the third section. The third section has a top and a bottom, the bottom section of the third section is a third section wall that defines a circumference and the top section is a circular third section wall that flows perpendicularly from the circumference of the third section wall, the circular third section wall defines the cavity within the dispenser bottom section, and the third section wall defines two centrally positioned third section attachment points. The first, second and third section are attached by at least two cords to each other.

An object of the present invention is to provide a candy or pill dispenser that converts into a toy after the candy or pill is consumed.

Another object of the present invention is to provide a physical toy to a child that will allow the child to improve his or her motor skills.

Yet another object of the present invention is to provide a child with a non-digital toy or game.

DRAWINGS

These and other features, aspects, and advantages of the present invention will become better understood with regard to the following description, appended claims, and drawings where:

DESCRIPTION

Figure 1:
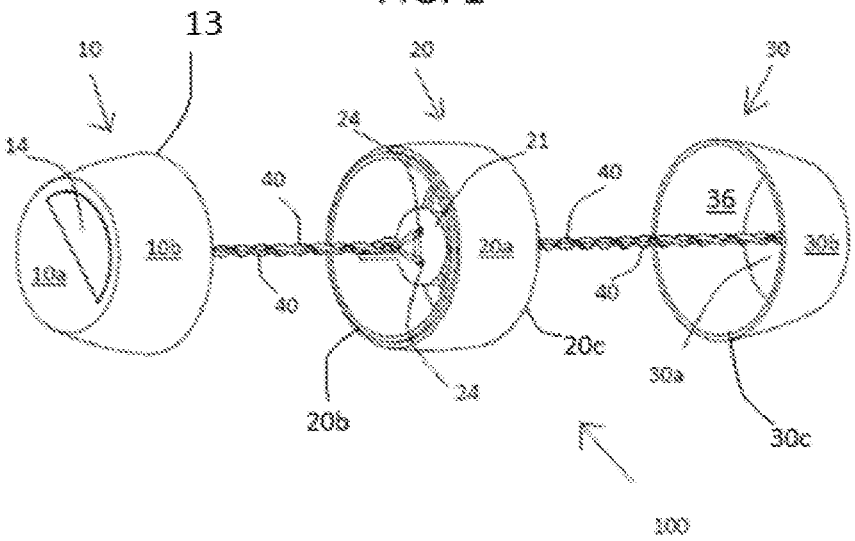
FIG. 1 shows a perspective view of one embodiment of the present invention.
Figure 2:
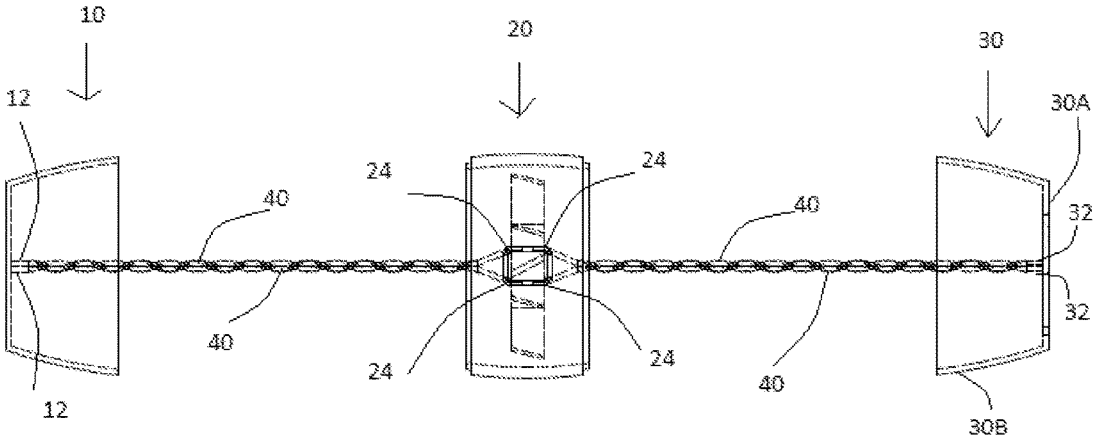
FIG. 2 shows a side view of another embodiment of the present invention.
Figure 3:
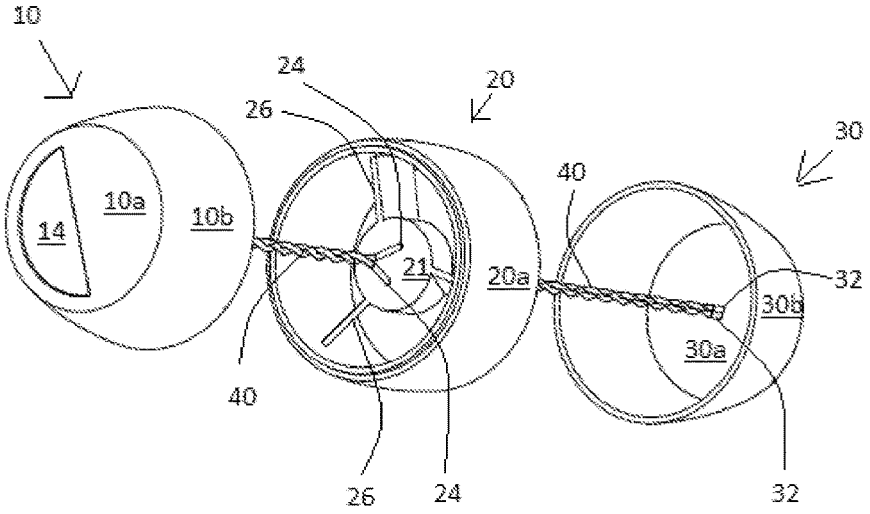
FIG. 3 shows a perspective view of the present invention.
Figure 4:
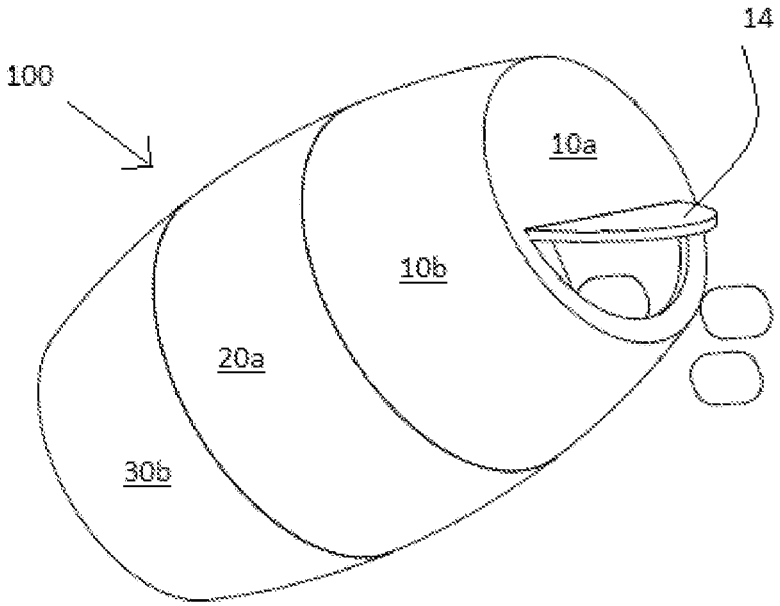
FIG. 4 shows a perspective view of the present invention wherein an item is being dispensed from the invention.

The present invention is directed to a dispenser that converts into a spinning toy, as referenced FIGS. 1-4. The dispenser 100 has a first section 10, a second section 20, and a third section 30. The first section 10 has a dispenser top section 10*a* with a circular cross section that defines a first section cavity (not numbered in the figures) within the circumference of the first section 10, the first section has a top 10*a* and a bottom 10*b*, the top section 10*a* of the first section 10 is a first section wall 10*a* that defines a circumference, the bottom section 10*b* of the first section is a circular first section wall 10*b* that flows perpendicularly from the circumference of the first section wall 10*a*, the circular first section wall 10*b* defines the cavity of the dispenser top section 10 and an open end, the open end of the first section dispenser top defines a circumference that is a first section rim 13, and the first section wall 10*a* defines two centrally positioned first section attachment points 12. A second section 20 is cylindrical ring that is defined by a circular central wall 20*a* that further defines a central axis structure 21 that is perpendicular to the central wall 20*a* and that is attached to the circular central wall 20*a* by at least two spokes 26, each spoke 26 allows any item within the circular central wall to pass from a side of the central axis structure 21 to another side of the central axis structure 21, the central axis structure 21 defines at least two centrally positioned second section attachment points, the circular central wall 20*a* has a top and a bottom end (not numbered in the figures), each end of the circular central wall bevels inward 20*b* and 20*c*, a pair of cords 40 each cord having a first and a second end (not numbered in the figures), each cord 40 attaches to one of the first section attachment points 12 and to one of the second section attachment points 24. And, a third section 30 that is a dispenser bottom section 30 with a cross section that defines a cavity within the circumference of the third section (not numbered in figures), the third section 30 has a top 30*b* and a bottom 30*a*, the bottom section 30*a* of the third section 30 is a third section wall 30*a* that defines a circumference and the top section 30*b* is a circular third section wall 30*b* that flows perpendicularly from the circumference of the third section wall 30*a*, the circular third section wall 30*b* defines the cavity (not numbered in figures) within the dispenser bottom section 30 and an open end, the open end of the first section dispenser top defines a circumference that is a third section rim 30*c*, the third section 30*a* wall defines two centrally positioned third section attachment points 32, and each cord 40 attaches to one of the third section attachment points 32 and to one of the second section attachment points 24. The first section top's rim 13 attaches to the bevel of the top section of the ring 20*b* and the third section dispenser bottom's rim 30*c* attaches to the bevel of the bottom section of the ring 20*c*.

In an embodiment of the present invention a door 14 is defined in the top section 10*a*. The door is used to empty the contents from within the dispenser.

In another embodiment of the present invention, two cords 40 are used and each cord 40 loops from either the dispenser top section 10 or dispenser bottom section 30 to the second section 20, thereby ensuring that the second section 20 is always centrally balanced between the dispenser bottom section 30 and the dispenser top section 10, when the toy is in use. This embodiment allows the toy to be manipulated vertically from the ground, something that could not have been possible using prior spinning toys.

In yet another embodiment of the present invention, the beveled edges of the second section fit within the dispenser's top section 10 and the dispenser's bottom section 30.

An advantage of the present invention is that it provides a candy or pill dispenser that converts into a toy.

Another advantage of the present invention is that it provides a physical toy to a child that allows the child to improve his or her motor skills.

Yet another advantage of the present invention is that it provides a child with a non-digital toy or game.

While the inventor's above description contains many specificities, these should not be construed as limitations on the scope, but rather as an exemplification of several preferred embodiments thereof. Many other variations are possible.

What is claimed is:

1. A dispenser that converts into a spinning toy, the dispenser comprises:

a first section that is a dispenser top section with a circular cross section, the first section dispenser top has an open and a closed end, the closed end of the first section dispenser top defines a hinged door and two centrally positioned first section attachment points, the open end of the first section dispenser top defines a circumference that is a first section rim;

a second section that is a cylindrical ring that has a top section and a bottom section, the ring attaches to a central axis structure via at least two spokes, the top section and bottom section of the ring each having an inward bevel, the central axis structure defines two centrally positioned second section attachment points;

a third section that is a dispenser bottom section with a circular cross section, the third section dispenser bottom has an open and a closed end, the closed end of the third section dispenser bottom defines two centrally positioned third section attachment points, the open end of the third section dispenser bottom defines a circumference that is a third section rim, the first section dispenser top's rim attaches to the bevel of the top section of the ring and the third section dispenser bottom's rim attaches to the bevel of the bottom section of the ring; and a pair of cords, each cord attaches to one of the first section attachment points of the dispenser top section, to one of the second section attachment points of the central axis structure, and each cord also attaches to one of the third section attachment points of the third section dispenser bottom.

* * * * *